US005814929A

United States Patent [19]

Jo

[11] Patent Number: 5,814,929

[45] Date of Patent: Sep. 29, 1998

[54] ELECTRON GUN WITH QUADRUPOLE ELECTRODE STRUCTURE

[75] Inventor: Sung Ho Jo, Kumi, Rep. of Korea

[73] Assignee: LG Electronics Inc., Seoul, Rep. of Korea

[21] Appl. No.: 840,008

[22] Filed: Apr. 24, 1997

Related U.S. Application Data

[63] Continuation of Ser. No. 446,567, May 19, 1995, abandoned.

[30] Foreign Application Priority Data

Sep. 14, 1994 [KR] Rep. of Korea ..... 94-23251

[51] Int. Cl.[6] ..... H01J 29/46

[52] U.S. Cl. ..... 313/414; 313/460; 313/428; 315/382.1

[58] Field of Search ..... 313/414, 432, 313/436, 437, 439, 441, 460, 412, 428; 315/382, 382.1, 368.15

[56] References Cited

U.S. PATENT DOCUMENTS

| | | | |
|---|---|---|---|
| Re. 34,339 | 8/1993 | Ogakabe | 313/414 |
| 4,737,682 | 4/1988 | Alig et al. | 313/414 |
| 4,886,999 | 12/1989 | Yamane et al. | 313/414 |
| 4,887,009 | 12/1989 | Bloom et al. | 313/414 |
| 5,142,190 | 8/1992 | Koh | 313/414 |
| 5,162,695 | 11/1992 | Shimona et al. | 313/414 |
| 5,325,013 | 6/1994 | Johnson et al. | 313/414 |
| 5,532,547 | 7/1996 | Park et al. | 313/414 |

*Primary Examiner*—Sandra L. O'Shea
*Assistant Examiner*—Michael Day
*Attorney, Agent, or Firm*—Jacobson, Price, Holman & Stern, PLLC

[57] ABSTRACT

An in-line electron gun for a color CRT includes a static electrode (39') applied with a static voltage, and a dynamic electrode (40') applied with a dynamic voltage. A side of the static electrode (39') facing toward the dynamic electrode (40') is formed with a common opening for the electron beams, and a plain electrode (21) having three apertures (20) is positioned inside the static electrode (39'). The dynamic electrode (40') has a pair of lens reinforcement partitions (38) having round horizontal partitions (41) disposed in a vicinity of the apertures (20) and has a curvature similar to that of the apertures (20), and linear partitions (42) formed integral with the round partitions (41) to provide a static facing side of the dynamic electrode (40') with a quadrupole effect. The in-line electron gun reduces the voltage difference of the peak-to-peak voltage of the dynamic voltage reducing the production cost of the dynamic voltage supply.

3 Claims, 6 Drawing Sheets

FIG. 1 (PRIOR ART)
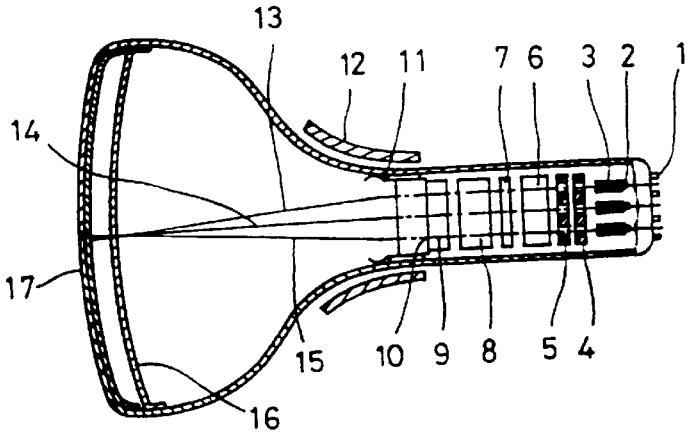
FIG. 8
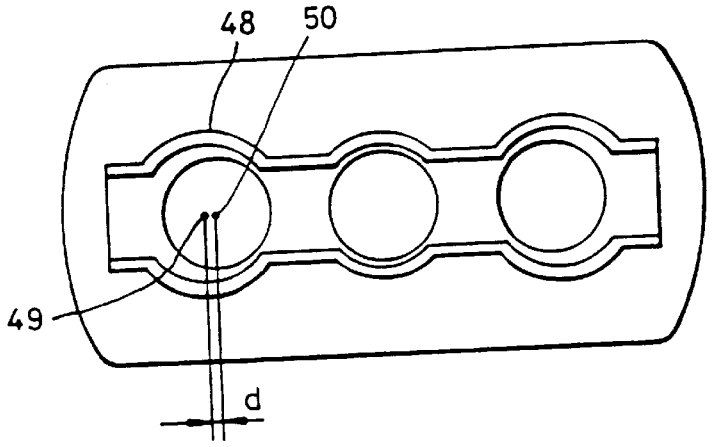
FIG. 9
(UNIT : VOLT)
| VOLTAGE / EMBODIMENT | DYNAMIC VOLTAGE | | PEAK-TO-PEAK |
|---|---|---|---|
| | MINIMUM | MAXIMUM | |
| CONVENTIONAL | 6400 | 6830 | 430 |
| EMBODIMENT IN FIGS. 5A-5C | 6400 | 6770 | 370 |
| EMBODIMENT IN FIGS. 6A,6B | 6400 | 6840 | 440 |
| EMBODIMENT IN FIGS. 7A-7C | 6400 | 6810 | 410 |

FIG. 5A
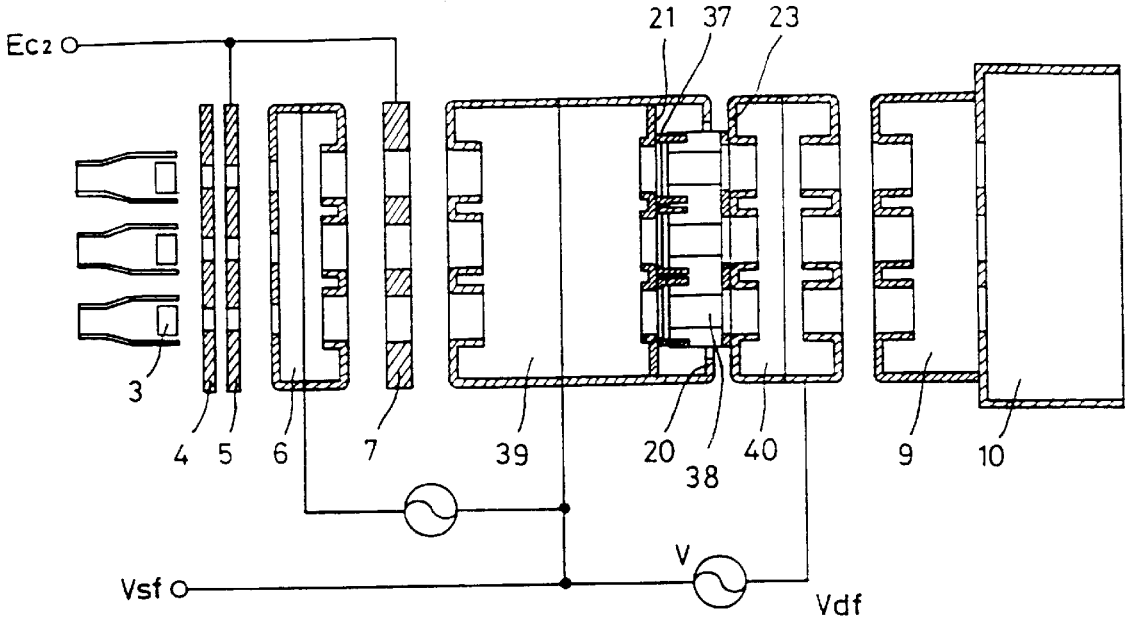
FIG. 5B
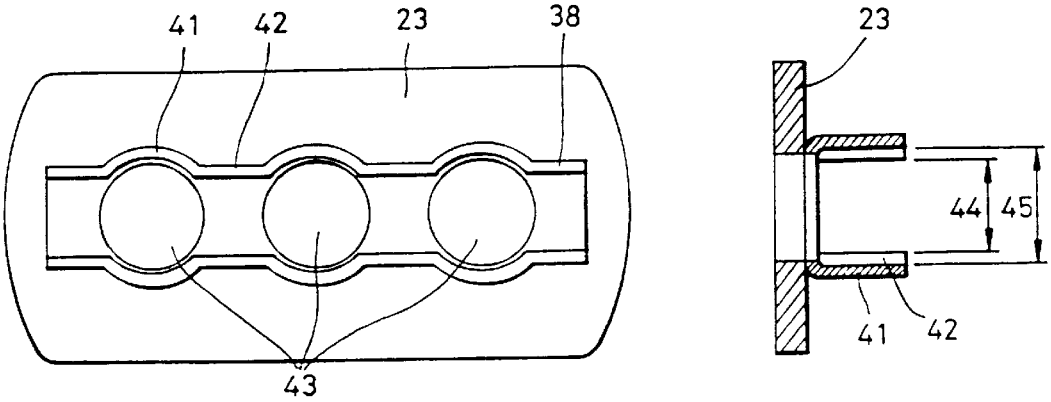
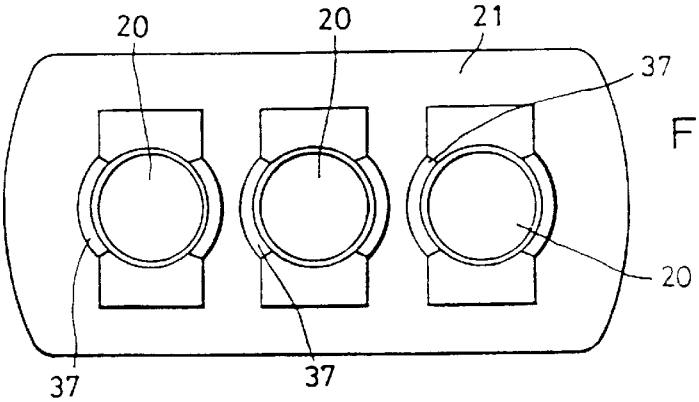
FIG. 5C

FIG. 7A
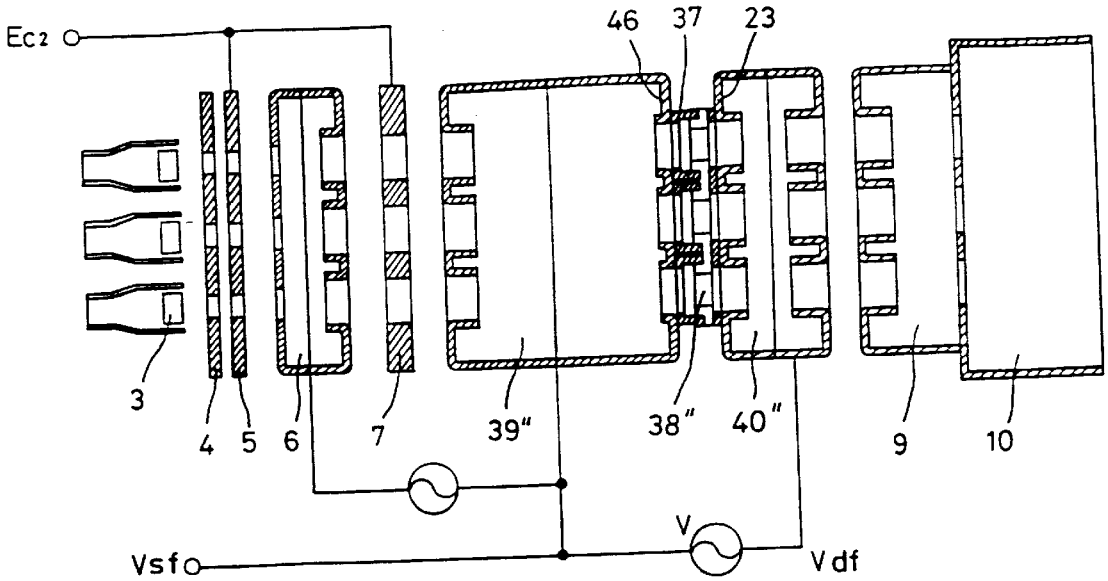
FIG. 7B
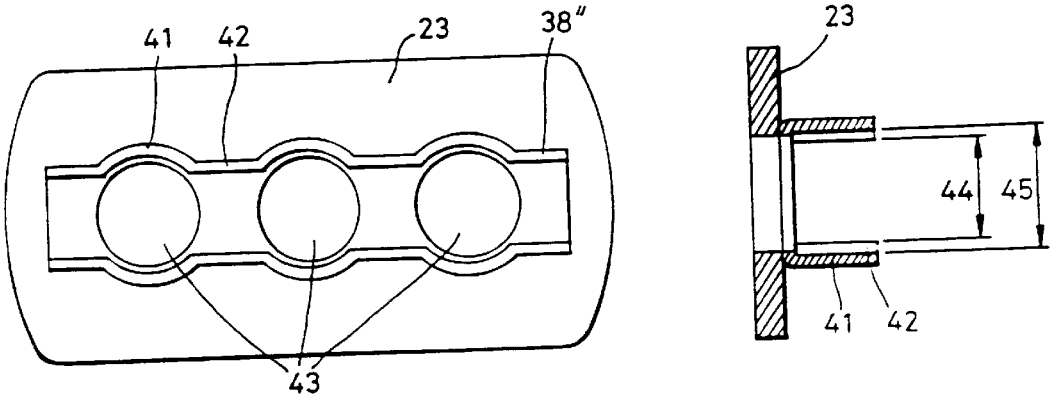
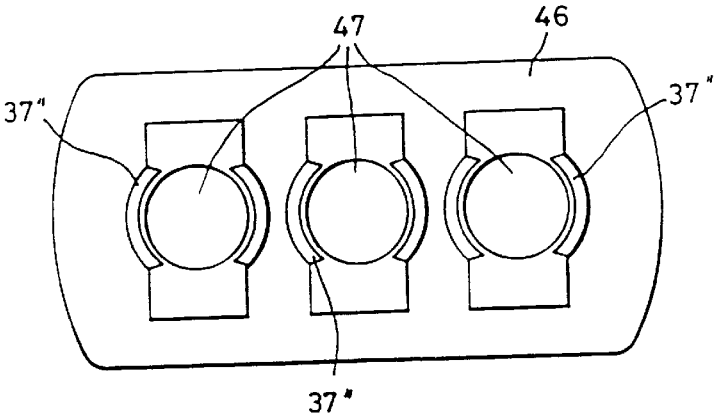
FIG. 7C

ELECTRON GUN WITH QUADRUPOLE ELECTRODE STRUCTURE

This application is a continuation of application Ser. No. 08/446,567, filed May 19, 1995, now abandoned.

BACKGROUND OF THE INVENTION

1. Field of the Invention

The present invention relates to an electron gun for a color cathode-ray tube which can reduce the voltage difference between the maximum and minimum values, i.e., a peak-to-peak voltage, of a dynamic voltage, vertically lengthening a beam spot thereby preventing focus deterioration at the corners of a screen.

2. Description of the Prior Art

In an in-line type electron gun for a color cathode-ray tube, three cathodes are disposed therein at regular intervals perpendicular to an electron beam path, so that the electron beam radiated from a cathode can reach the screen at a given strength and configuration.

A structure of a typical color cathode-ray tube will be discussed with reference to FIG. 1. Referring to FIG. 1, a typical color cathode-ray tube contains three cathodes 3, standing independently, for radiating electron beams; a control electrode 4, disposed at given distance from the cathode 3, for controlling the electron beams; an acceleration electrode 5, a first acceleration/focusing electrode 6, a second acceleration/focusing electrode 7, a third acceleration/focusing electrode 8, and a fourth acceleration/focusing electrode 9 which are positioned at a given distance from the control electrode 4; a shield cup 10, positioned in front of the fourth acceleration/focusing electrode 9, to which a bulb space contactor 11 is attached.

The cathodes 3 heated by a voltage source radiate thermion, which heat originates from a heater 2, or a filament built therein. This thermion gathers to form electron beams 13, 14 and 15.

The electron beams 13, 14 and 15 are controlled by the control electrode 4 and accelerated by the acceleration electrode 5. Thereafter, divergence of the electron beams 13, 14, and 15 is suppressed by the first, second, and third acceleration/focusing electrode 6, 7, and 8 which form a preceding focus lens. These electron beams are accelerated and focused by the third and fourth acceleration/focusing electrode which form a main lens, and impinge on a fluorescent screen 17 through a shadow mask 16 to let fluorescent material thereon emit light.

FIGS. 2A–2C show the structure of an in-line dynamic focus electron gun, built in the typical color cathode-ray tube depicted in FIG. 1.

The third acceleration/focusing electrode 8 shown in FIG. 1 is composed of a static electrode 18 and a dynamic electrode 19, which are separated from each other at regular intervals.

The static electrode 18 has three beam-passing apertures 20 which correspond to the respective electron beams, confronting the dynamic electrode 19. A plain electrode 21 is positioned at a place backwardly regularly distant from the beam-passing apertures 200. On the plain electrode 210, vertical partitions 22 are, facing the dynamic electrode 19, welded on the right and left side of the two beam-passing apertures 200 which are at the outer portion of the static electrode 18 (see FIG. 2C).

On a plate 230 of the dynamic electrode 19, horizontal partitions 24 are horizontally welded at the upper and lower sides of the three beam-passing apertures 200 (see FIG. 2B). A part of the horizontal partitions 24 of the dynamic electrode 19 is inserted in an aperture assembly (a part constituted by both the beam-passing apertures and the vertical partitions) of the static electrode 18.

The function of the typical in-line electron gun for a color cathode-ray tube structured as above will be discussed with reference to FIGS. 2A–2C, 3, and 4.

As a dynamic voltage Vdf depicted in FIG. 3 is applied to the dynamic electrode 19, both the static electrode 18 and the dynamic electrode 19 form a quadrupole lens effect 31, shown in FIG. 4, to lengthen vertically a beam spot, like an oval shape.

Specifically, in order to meet the recent, growing demand and trend for wider TV screens with uniform resolution throughout the screen, it has been necessary to improve a focus characteristic at the corners of the screen.

For this purpose, a dynamic voltage closest to a static voltage Vsf (the dotted circle 30 in FIG. 3) is applied to the central portion of the screen; a dynamic voltage farthest from the static voltage Vsf (the dotted circle 29 in FIG. 3) is applied to the corners of the screen, which dynamic voltage Vdf has a small-pulsating component 27, as shown in FIG. 3, varying in accordance with a horizontal deflection current on a deflection yoke, and a large-pulsating component 28 varying in accordance with a vertical deflection current on the deflection yoke.

Accordingly, because there is no potential difference between the static voltage Vsf and the dynamic voltage Vdf in the central portion of the screen, there is no quadrupole lens effect, so that the beam spot 36 becomes a true circle. In the corners of the screen, because a maximum potential difference (usually 400 to 600V) appears, there is a strong quadrupole lens effect, so that the beam spot 36 becomes an oval shape of which the vertical length is longer than the horizontal length.

This vertically elongated beam spot compensates for an over-focusing phenomenon (a phenomenon in which a focal length becomes shorter) which occurs in the vertical direction of the electron beams.

This beam spot also compensates for an under-focusing phenomenon (a phenomenon in which a focal length becomes longer, in other words, a de-focusing of a deflection yoke) which occurs in the horizontal direction of the electron beams. These two faults take place due to an inadequate deflection of magnetic field when the deflection yoke 12 deflects the electron beams to the corners of the screen. As a result uniform resolution throughout the screen can be obtained.

Like the foregoing, in the typical in-line electron gun for a color cathode-ray tube, enhancement of resolution over a full screen is performed by varying (usually 430–500V) the voltage difference between a maximum and a minimum of the dynamic voltage Vdf, i.e., a peak-to-peak voltage, like the waveform in FIG. 3.

However, the cost of producing a power supply device which yields a large peak-to-peak voltage is much higher than that of a power supply device which yields a small peak-to-peak voltage. Thus, the cost of producing a conventional electron gun is relatively high. This is a disadvantage of the conventional electron gun.

In addition, because an unnecessary gap appears, when the dynamic electrode and the static electrode are assembled together, between the beam-passing apertures and the vertical and horizontal partitions 22 and 24, it is necessary to increase the dynamic voltage, if the same degree of the quadrupole lens effect as the conventional electron gun is required. This is another disadvantage of the conventional electron gun.

SUMMARY OF THE INVENTION

It is an object of the present invention to provide an electron gun which can reduce a peak-to-peak voltage of a dynamic voltage and vertically elongate a beam spot into an oval shape. The electron gun of the present invention can thus prevent focus deterioration occuring at the corners of a screen of a cathode-ray tube.

In an aspect of the present invention, there is provided an electron gun for a color cathode-ray tube, having a dynamic electrode with three beam-passing apertures and a static electrode with three beam-passing apertures confronting concentrically respective beam-passing apertures on the dynamic electrode, comprising a pair of lens reinforcement partitions which projectingly stand at regular height at an upper and lower side of the respective beam-passing apertures on the dynamic electrode.

This and other features and advantages of the present invention will be apparent to those skilled in the art from the following detailed description, taken together with the accompanying drawings, in which like reference numerals refer to like parts.

BRIEF DESCRIPTION OF THE DRAWINGS

FIG. 1 is a longitudinal sectional view showing a structure of a general color cathode-ray tube.

FIG. 5A is a longitudinal sectional view simply showing a structure of an in-line electron gun for a color cathode-ray tube according to the present invention.

FIG. 5B is a cross-sectional view showing a dynamic electrode depicted in FIG. 5A.

FIG. 5C is a cross-sectional view showing a static electrode depicted in FIG. 5A.

FIG. 7A is a longitudinal sectional view simply showing a structure of an electron gun according to yet another embodiment of the present invention.

FIG. 7B is a cross-sectional view showing a dynamic electrode depicted in FIG. 7A.

FIG. 7C is a cross-sectional view showing a static electrode depicted in FIG. 7A.

FIG. 8 is a structural view showing a dynamic electrode modified for compensation for a dynamic convergence shift phenomenon.

FIG. 9 is a table showing data measured by a computer simulation on each the embodiments of the present invention.

DETAILED DESCRIPTION OF THE PREFERRED EMBODIMENTS

FIGS. 5A through 5C show a structure of an in-line electron gun for a color cathode-ray tube according to the present invention.

Figure 2A:
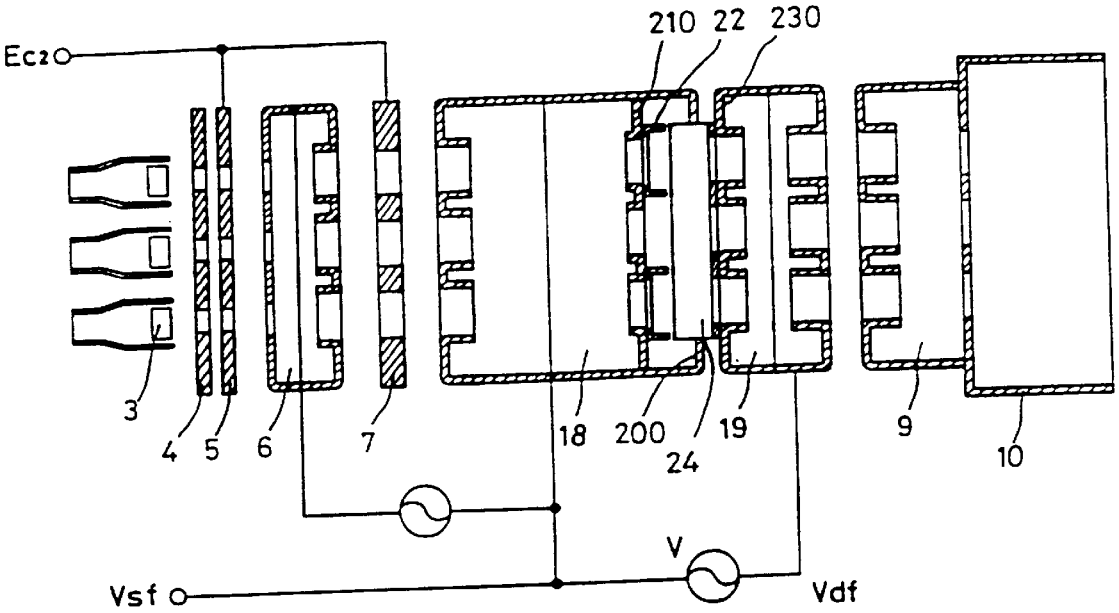
FIG. 2A (PRIOR ART)
FIG. 2A is a longitudinal sectional view simply showing a structure of a conventional in-line electron gun for a color cathode-ray tube.
Figure 2B:
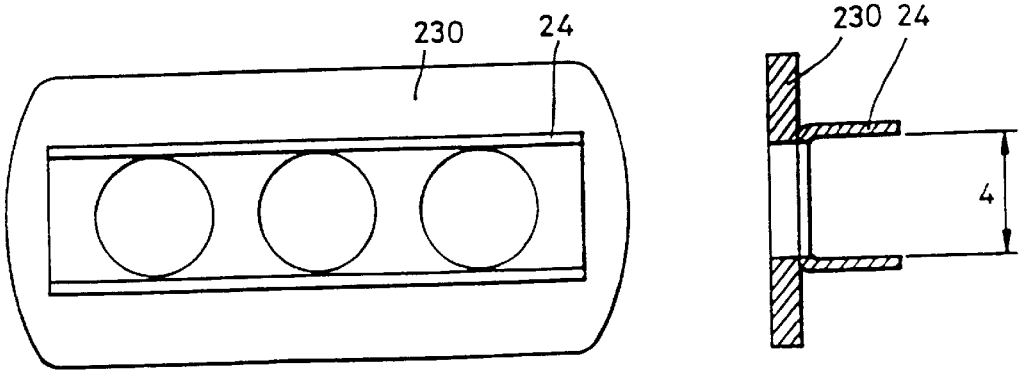
FIG. 2B (PRIOR ART)
FIG. 2B is a cross-sectional view showing a dynamic electrode depicted in FIG. 2A.
Figure 2C:
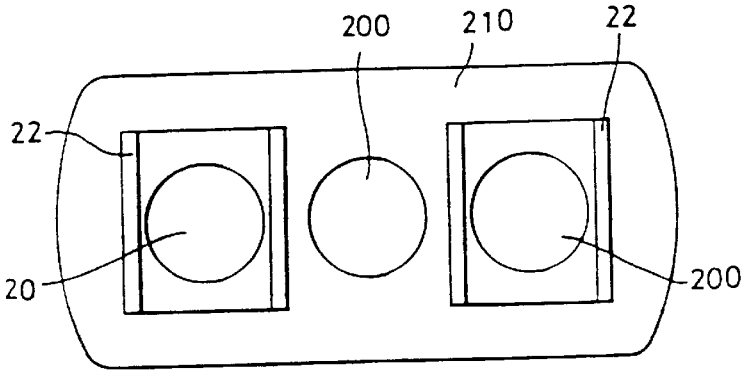
FIG. 2C (PRIOR ART)
FIG. 2C is a cross-sectional view showing a static electrode depicted in FIG. 2A.
Figure 3:
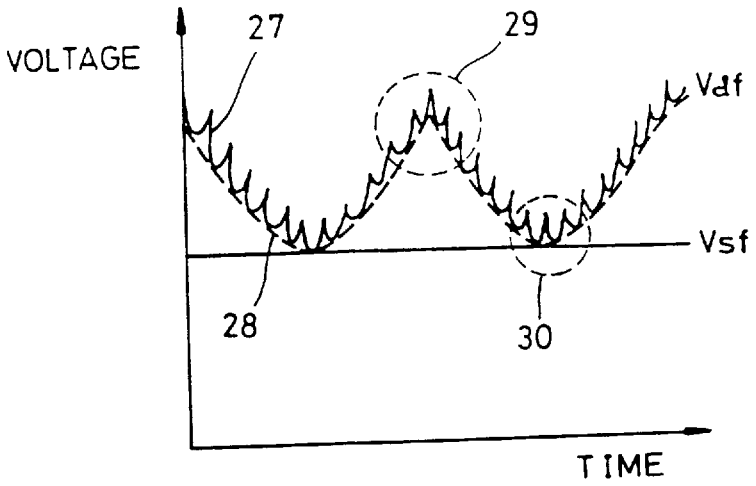
FIG. 3 (PRIOR ART)
FIG. 3 is a view showing waveforms of a dynamic voltage and a static voltage.
Figure 4:
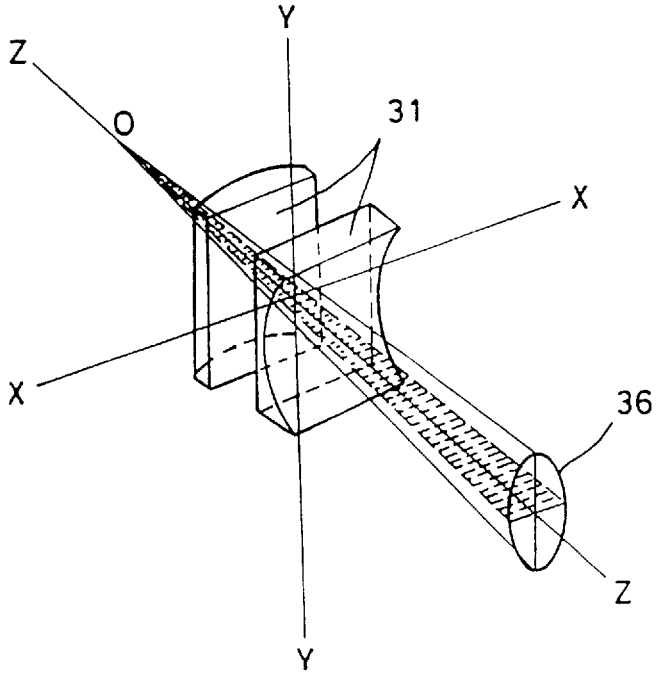
FIG. 4 (PRIOR ART)
FIG. 4 is an imaginary view showing a quadrupole lens effect.

With reference to FIG. 5A, a third acceleration/focusing electrode is, as well as a conventional electron gun depicted in FIGS. 2A to 2C, divided into two electrodes, that is, a static electrode 39 and a dynamic electrode 40 having plate 23. The static electrode 39 is located in the direction closer to a cathode, i.e. in the rear of an electron gun, while the dynamic electrode 40 is located in the front of an electron gun. The side of the static electrode 39 facing the dynamic electrode 40 is formed with a common opening.

Referring to FIG. 5C, there are three beam-passing apertures 20 on the static electrode 39. A plain electrode 21 is positioned at regular intervals in the rear of the apertures 20. On the plain electrode 21, cylindrical partitions 37 are projectingly welded around the respective beam-passing apertures 20, facing the dynamic electrode 40.

With regard to FIG. 5B, the dynamic electrode 40 has also three beam-passing apertures 43. Round partitions 41 are projectingly welded, confronting the static electrode 39, at the upper and lower sides of the beam-passing apertures 43, which partitions 41 form horizontal partitions 38, being united with linear partitions 42 standing between the respective beam-passing apertures. Here, in the horizontal partitions 38, it is understandable that a gap between the linear partitions 42 is smaller than the diameter 45 of the beam-passing apertures 43. The horizontal partitions 38 are hereinafter referred to as lens reinforcement partitions.

The lens reinforcement partitions are assembled with the cylindrical partitions 37 on the static electrode 39. It engages with the cylindrical partitions 37 at regular gaps.

In the electron gun structured as above, when assembling the lens reinforcement partitions 38 with the cylindrical partitions 37, the gap between them can become smaller than that of the conventional electron gun. That is, there are no unnecessary spaces between the beam-passing apertures and the partitions.

As a result, the same degree of the quadrupole lens effect as provided by the conventional electron gun is achieved using a smaller dynamic voltage. That is, the maximum dynamic voltage can be lower than that of the conventional electron gun.

Accordingly, cost of production of the dynamic voltage supply device can be reduced compared with the conventional supply device. Therefore, a disadvantage of the conventional electron gun can be overcome by the present invention.

Figure 6A:
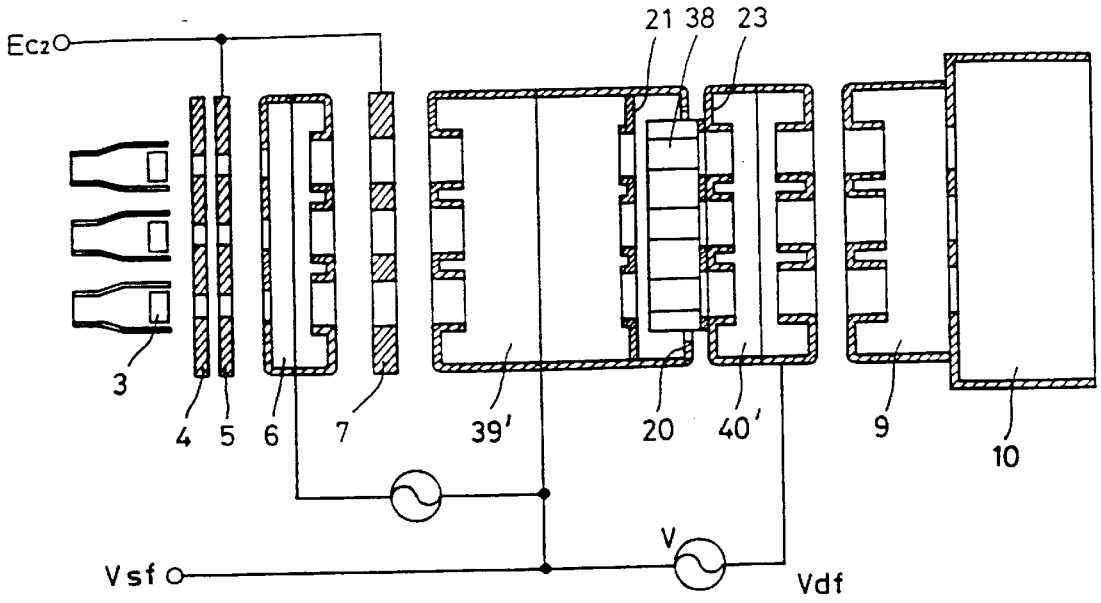
FIG. 6A is a longitudinal sectional view simply showing a structure of an electron gun according to another embodiment of the present invention.
Figure 6B:
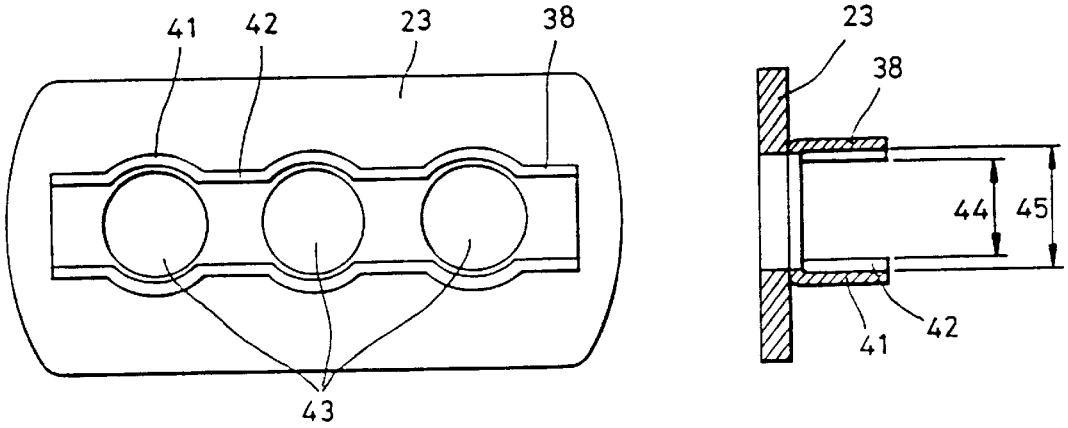
FIG. 6B is a cross-sectional view showing a dynamic electrode depicted in FIG. 6A.

FIGS. 6A and 6B show another preferred embodiment of the present invention.

Comparing with FIGS. 5A through 5C, there are no cylindrical partitions on the static electrode 39 illustrated in FIG. 5C. That is, a static electrode 39' adapted in this embodiment has the same structure as the static electrode (refer to FIG. 2C) of the conventional electron gun; a dynamic electrode 40' has the lens reinforcement partitions 38 which could be seen in FIG. 5B.

In this embodiment illustrated in FIGS. 6A and 6B, the quadrupole lens effect is obtained by only this lens reinforcement partitions without the vertical partitions 37 depicted in FIG. 5C. The quadrupole lens effect according to this embodiment is weaker than that of the embodiment in FIGS. 5A to 5C, but greater than that of the conventional electron gun.

FIGS. 7A to 7C show yet another preferred embodiment of the present invention.

Comparing FIG. 7C with FIG. 5C, there are welded round vertical partitions 37", instead of the cylindrical partitions 37 depicted in FIG. 5C, at the right and left side of the respective beam-passing apertures 47.

In efficacy, even though the quadrupole lens effect is weaker than that of the embodiment illustrated in FIGS. 5A through 5C (but is greater than that of the conventional electron gun) , because a contacting surface between the lens reinforcement partitions 38" and the vertical partitions 37" becomes narrower, the possibility of an unexpected discharge spark can be avoided, and the cost of production can be reduced.

The structure of a dynamic electrode depicted in FIG. 8 indicates practical lens reinforcement partitions for compensation of a dynamic convergence shift phenomenon which occasionally takes place. This structure is applicable to all of the embodiments which have been discussed so far.

The dynamic convergence shift phenomenon is the phenomenon in which two outer beams 13 and 15, see FIG. 1, depart from a central beam 14 on account of deterioration of an STC (static convergence characteristic) which occurs when the two outer beams 13 and 15 converge to the central beam 14, as shown in FIG. 1. This characteristic will be compromised owing to the lack of convergent power of a main lens as a dynamic voltage is applied.

For compensation of the dynamic convergence shift phenomenon, centers 49 of the round horizontal partitions 48 contiguous to the two outer beam-passing apertures are respectively shifted outwardly by any given interval "d", from centers 50 of the beam-passing apertures.

FIG. 9 is a table showing dynamic voltage data measured by a computer simulation of each of the embodiments illustrated in FIGS. 5A–5C, FIGS. 6A, 6B, and FIGS. 7A–7C. As shown, in the embodiment illustrated in FIGS. 5A–5C, there appears a voltage reduction of 14% as compared with the peak-to-peak voltage of the conventional electron gun.

In the embodiment illustrated in FIGS. 6A and 6B, there is no voltage reduction of a peak-to-peak voltage. Yet the quadrupole lens effect equivalent to that of the conventional electron gun can be obtained without using the round vertical partitions.

In the embodiment illustrated in FIGS. 7A–7C, there appears less voltage reduction than the embodiment in FIGS. 5A–5C (around 5%), but the possibility of an unexpected discharge spark at the quadrupole lens can be decreased.

What is claimed is:

1. An in-line electron gun for a color cathode-ray tube including a cathode, a control electrode, and an acceleration electrode, a preceding focus lens having at least two electrodes for focusing electron beams, and a main lens having a first acceleration/focusing electrode and a second acceleration/focusing electrode for accelerating and focusing said electron beams and projecting said beams on a fluorescent screen of said cathode-ray tube, comprising:

said first acceleration/focusing electrode divided into a static electrode applied with a static voltage and a dynamic electrode applied with a dynamic voltage, with said static and dynamic electrodes being separated from each other at constant intervals, a side of said static electrode facing toward said dynamic electrode formed with a common opening for said electron beams, and a plain electrode having three apertures positioned inside said static electrode at constant intervals from said opening, and said dynamic electrode having a pair of lens reinforcement partitions formed integral with round horizontal partitions which are positioned in a vicinity of said apertures and which have a curvature similar to that of said apertures, and linear partitions formed integral with said round horizontal partitions to provide a static facing side of said dynamic electrode with a quadrupole lens effect.

2. The in-line electron gun as claimed in claim 1, wherein a side of said plain electrode facing toward said dynamic electrode is provided with vertical partitions respectively positioned near apertures of said dynamic electrode to further provide said quadrupole lens effect, and said vertical partitions engage with partitions of said dynamic electrode at constant gaps.

3. The in-line electron gun of claim 1, wherein the static electrode further comprises vertical partitions having a same curvature as said common opening, the vertical partitions being provided at a right and left side of the common opening so as to be inserted in a space defined between the lens reinforcing partitions at an upper and lower side of the apertures on the dynamic electrode, wherein the vertical partitions are relatively thin so as to extend substantially perpendicular to the surface of the static electrode.

* * * * *